US007779588B1

(12) United States Patent
Bruning

(10) Patent No.: US 7,779,588 B1
(45) Date of Patent: Aug. 24, 2010

(54) CONCRETE FOUNDATION FOR SUPPORTING A POLE THEREON

(76) Inventor: William E. Bruning, 13826 Pierce St., Omaha, NE (US) 68144

( * ) Notice: Subject to any disclaimer, the term of this patent is extended or adjusted under 35 U.S.C. 154(b) by 0 days.

(21) Appl. No.: 12/383,404

(22) Filed: Mar. 24, 2009

(51) Int. Cl.
*E02D 27/32* (2006.01)
*E02D 27/42* (2006.01)

(52) U.S. Cl. ..... 52/297; 52/296; 52/604; 52/835; 52/169.9; 52/169.13; 52/170

(58) Field of Classification Search ..... 52/40, 52/169.9, 169.13, 170, 294–298, 604, 835, 52/741.15; 405/244, 250–252; 248/910
See application file for complete search history.

(56) References Cited

U.S. PATENT DOCUMENTS 565,618 A * 8/1896 Harman ..... 52/297
573,777 A * 12/1896 Fry et al. ..... 52/166
715,362 A * 12/1902 Etheridge ..... 52/835
2,032,030 A * 2/1936 Talen ..... 52/166
2,057,018 A * 10/1936 Dillon ..... 256/19
2,374,624 A 2/1942 Schwendt
2,344,782 A * 3/1944 Muller ..... 52/101
2,383,544 A * 8/1945 Guimont ..... 52/283
2,664,739 A * 1/1954 Marcy ..... 52/474
3,282,001 A * 11/1966 Bigalow ..... 52/292
3,946,569 A * 3/1976 Stuber ..... 405/303
4,262,439 A * 4/1981 Dinan et al. ..... 40/606.03
2002/0166302 A1* 11/2002 Ogorchock ..... 52/294

* cited by examiner

*Primary Examiner*—Robert J Canfield
(74) *Attorney, Agent, or Firm*—Dennis L. Thomte; Thomte Patent Law Office LLC

(57) ABSTRACT

A concrete foundation is described which is adapted to be embedded in the ground for supporting a pole thereon. The foundation is comprised of a vertically disposed central section having upper and lower ends with a base section embracing the lower end of the central section and being wedged thereagainst to anchor the central section in the ground. If additional weight is needed, one or more base sections may be stacked on top of the lowermost base section.

7 Claims, 4 Drawing Sheets

CONCRETE FOUNDATION FOR SUPPORTING A POLE THEREON

BACKGROUND OF THE INVENTION

1. Field of the Invention

This invention relates to a concrete foundation which adapted to be embedded in the ground for supporting a pole thereon. More particularly, this invention relates to a concrete foundation which includes a vertically disposed central section and a base portion which embraces the central section and which engages the same to prevent movement of the central section.

2. Description of the Related Art

All wayside signals on the Union Pacific Railroad previously required a foundation that was buried in the ground to a depth of six feet or so to properly anchor the signal fixtures against the considerable wind-loading brought to bear on their towering surfaces. The foundation itself consisted of concrete sections of manageable size which stacked one on top of the other in several configurations to form a dead weight mass which was held together by four one-inch steel bolts with nuts at each end. While most railroads now have lifting equipment to handle a pre-assembled unit, it was necessary to have a sectionalized foundation when they were manually assembled in the field.

To tie all sections of the foundation together, and also have a six inch or so bolt projection at the top, on which to mount the signal, required four 1×84" bolts. These bolts, which must be hot-dipped galvanized, together with the required oversized galvanized nuts and washers, are the most expensive elements of the foundation system.

The Burlington Northern Railroad had a similar "pedestal type" sectional foundation which they used for a number of years. However, once their crews were provided proper lifting equipment, they no longer embraced the notion of using sectional-type foundations and adopted a monolithic unit weighing about two thousand pounds which was buried to a depth of just under five feet. It is designed with deep recesses on all four sides providing excellent earth-compaction and is a very serviceable product.

Because of its monolithic design, it does not require full length bolts as is the case for holding a sectional foundation system together. Since the purpose of the bolts is only to serve as a means to secure the signal fixtures to the foundation shorter lengths of bolts are embedded in the concrete, with the embedded end bent sharply to provide a good anchor in the concrete. Obviously, the set-up concrete prevents the bolts from pulling out or having any movement whatsoever.

While there are other costs associated with the pedestal-type sectional foundations (additional steel wire, galvanizing, more forms, etc.) the main cost is in the hot-dipped galvanized one-inch diameter bolts. Union Pacific foundations require four each 1×84" (28 feet) versus Burlington Northern foundations which require four each 1×36" bolts (12 feet).

Before the consolidation trend started 30 years ago, there were perhaps 25 Class I railroads, and each had its own signal foundation standards. Most had some version of the sectional foundation for the reasons described earlier, with the most common utilizing inter-locking concrete sections supplied by the Permacrete Company and were adopted as the AAR (Association of American Railroads) standard.

Railroads using this design included Illinois Central, Kansas City Southern, Missouri Pacific and the eastern railroads which later became Norfolk southern and CSX Systems. The Santa Fe primarily used the galvanized steel foundation supplied by Safetran Corp. The union Pacific has used the pedestal-type sectional for over 50 years. The Burlington Northern and Chicago and Northwestern both adopted the monolithic design before they merged to form respectively the BNSF and the Union Pacific.

Several years ago, there was a fatal accident when a signal crewman died in a cave-in of a hole being dug to install a signal foundation. As a result of this accident, and perhaps others. The railroad involved restricted the depth to which a hole could be dug which might endanger a workman. It is believed the new limit must be around five feet.

For the shorter foundation to provide the required stability, it was necessary to go to a larger base plate than the 32"×32"×4" called for in their original design. The new base was increased to 57"×57"×6" and weighed 1620 pounds which added desired stability in addition to the greatly increased horizontal surface for earth compaction.

SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

A concrete foundation is disclosed which is adapted to be embedded in the ground for supporting a pole such as a wayside signal pole thereon. The foundation includes a vertically disposed central section having upper and lower ends. The central section of the foundation is tapered inwardly from its lower to its upper end so that the lower end of the central section has a greater width than the width of the upper end of the central section. The taper of the central section creates an angularly disposed outer peripheral edge or wall at the lower end of the central section. A generally horizontally disposed base section is also provided which has a central opening formed therein which is complimentary to the lower end of the central section so that the base section may be positioned around the lower end of the central section to anchor the same.

The central opening of the base section is defined by an angular wall which corresponds to the angularly disposed outer peripheral wall at the lower end of the central section so that the angular wall of the base section engages the angularly disposed outer peripheral wall at the lower end of the central section to resist upward movement of the central section with respect to the base section. The central section has a plurality of anchor bolts which are embedded therein which have threaded upper ends protruding from the upper end of the central section to which the pole to be supported may be secured.

In the preferred embodiment, the anchor bolts have lower ends which are spaced above the lower end of the central section. If additional weight is required to stabilize the central section, one or more base portions may be positioned on the first base portion.

In the preferred embodiment, the central section has a plurality of spaced-apart cavities or recesses formed therein which are spaced from the upper and lower ends of the central section and which are adapted to accommodate fill material to be positioned therein to add further weight to the foundation. In the preferred embodiment, the central section has a quadrilateral cross-section and the base portion has a quadrilateral periphery and the central opening has a quadrilateral configuration.

It is therefore a principal object of the invention to provide an improved concrete foundation which is adapted to be embedded into the ground supporting a pole thereon.

A further object of the invention is to provide a concrete foundation for a support pole or the like which has increased stability.

A further object of the invention is to provide a concrete foundation for a support pole which is less expensive to fabricate than the prior art foundations.

Still another object of the invention is to provide a concrete foundation including a central section and a base section positioned thereon and which is in engagement therewith to stabilize the central section.

Yet another object of the invention is to provide a concrete foundation which does not require the utilization of anchor bolts which extend completely through the foundation.

Still another object of the invention is to provide a concrete foundation of the type described which is comprised of two components; i.e., a central section and a base portion.

These and other objects will be apparent to those skilled in the art.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DESCRIPTION OF THE PREFERRED EMBODIMENT

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

Figure 1:
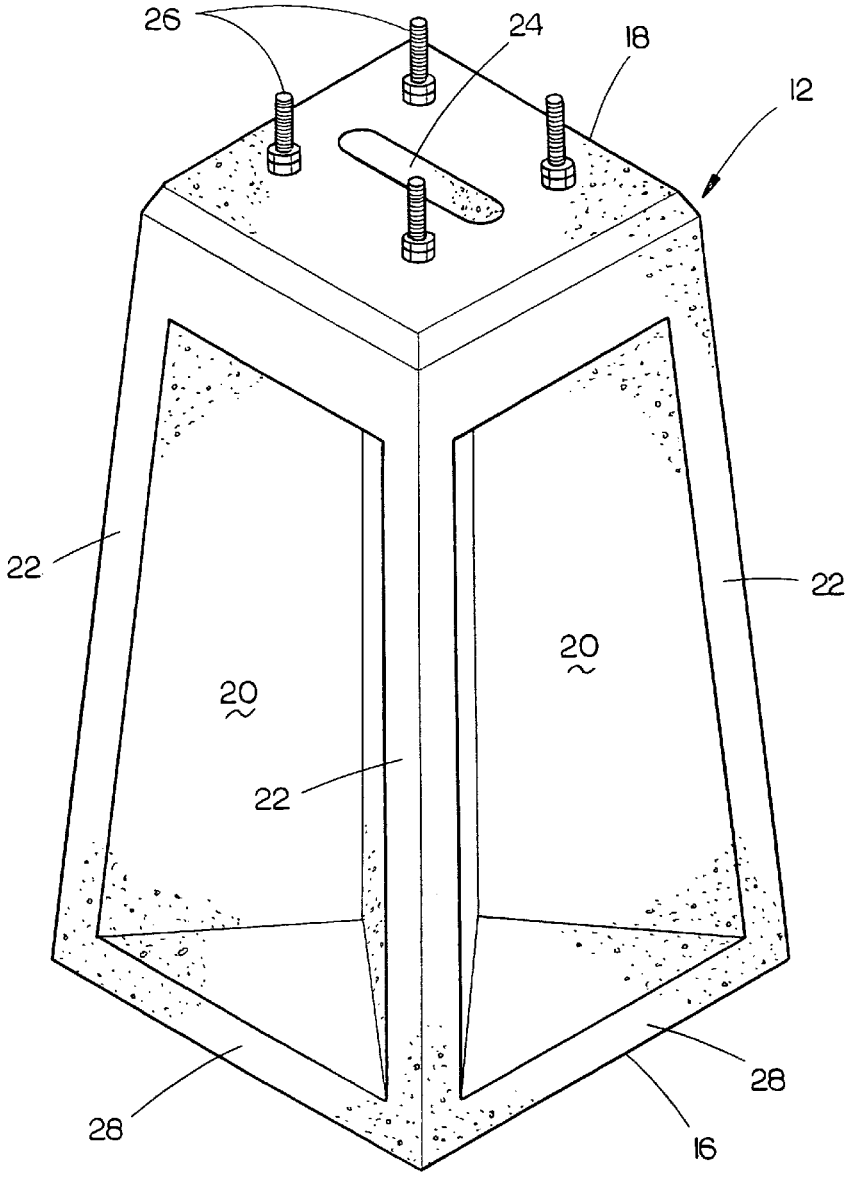
FIG. 1 is a perspective view of the central section of the foundation of this invention.
Figure 5:
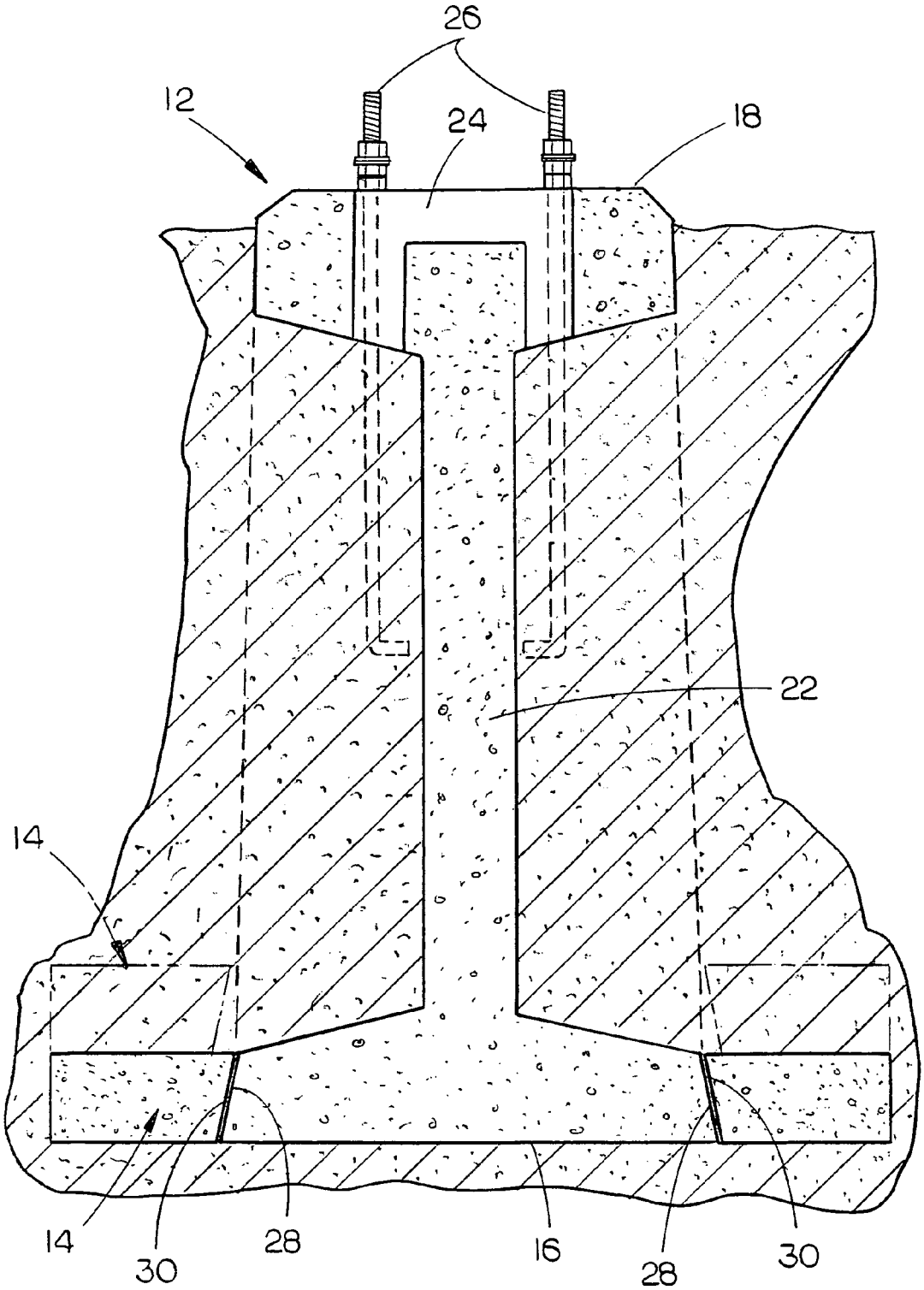
FIG. 5 is a sectional view illustrating the foundation of this invention embedded in the ground.

The foundation of this invention is referred to generally by the reference numeral 10 as seen in the drawings and is comprised of a concrete central section 12 and a concrete base section 14. Central section 12 includes a lower end 16 and an upper end 18. As seen, central section 12 is tapered inwardly from its lower end 16 to its upper end 18 so that the lower end 16 has a greater width or diameter than the width or diameter of the upper end 18 thereof. Preferably, concrete section 12 has four recesses or cavities 20 formed in the side walls thereof which are separated by webs 22. As seen in FIG. 1, the lower ends of the cavities or recesses 20 are spaced above the lower end 16 of the central section 12. As also seen in FIG. 1, the upper ends of the cavities or recesses 20 are spaced below the upper end 18 of the central section 12. The upper end 18 of central section 12 has a cavity 24 formed therein which extends downwardly thereinto and which communicates with one or more of the recesses 20 to enable electrical wires or the like to be extended upwardly through the cavity 24 for connection to the support or signal pole. A plurality of anchor bolts 26 are embedded in the central section 12 with the lower ends thereof being spaced well above the lower end of the central section 12 as illustrated in FIG. 5. The taper of the central section 12 from its lower end to its upper end defines an angularly disposed wall 28 as best illustrated in FIG. 5.

Figure 2:
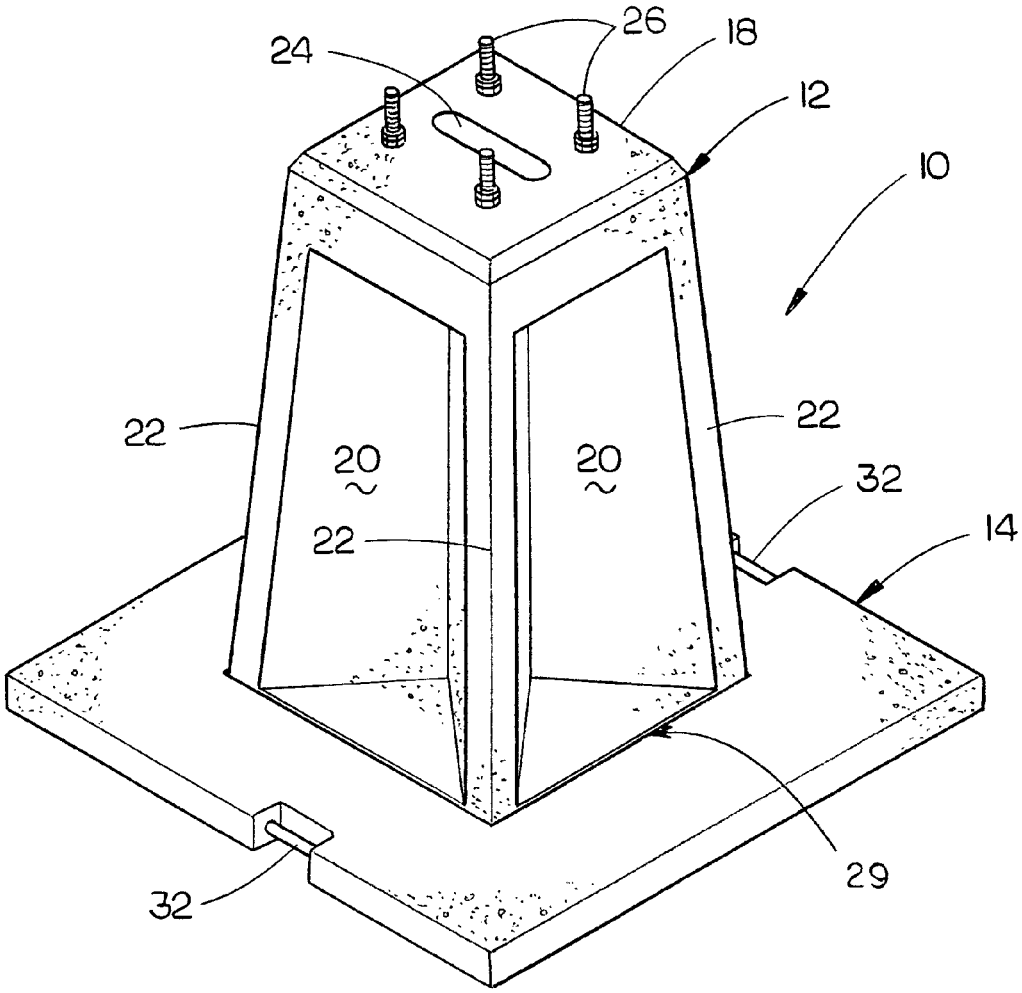
FIG. 2 is a perspective view of the foundation of this invention.
Figure 3:
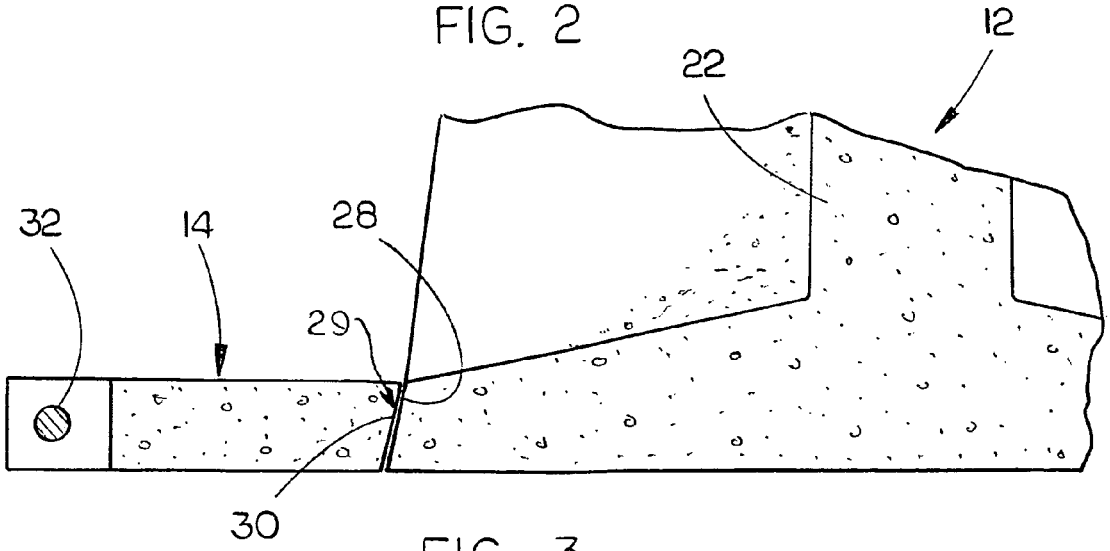
FIG. 3 is a partial sectional view illustrating the engagement of the base section of the invention with the lower end of the central section.
Figure 4:
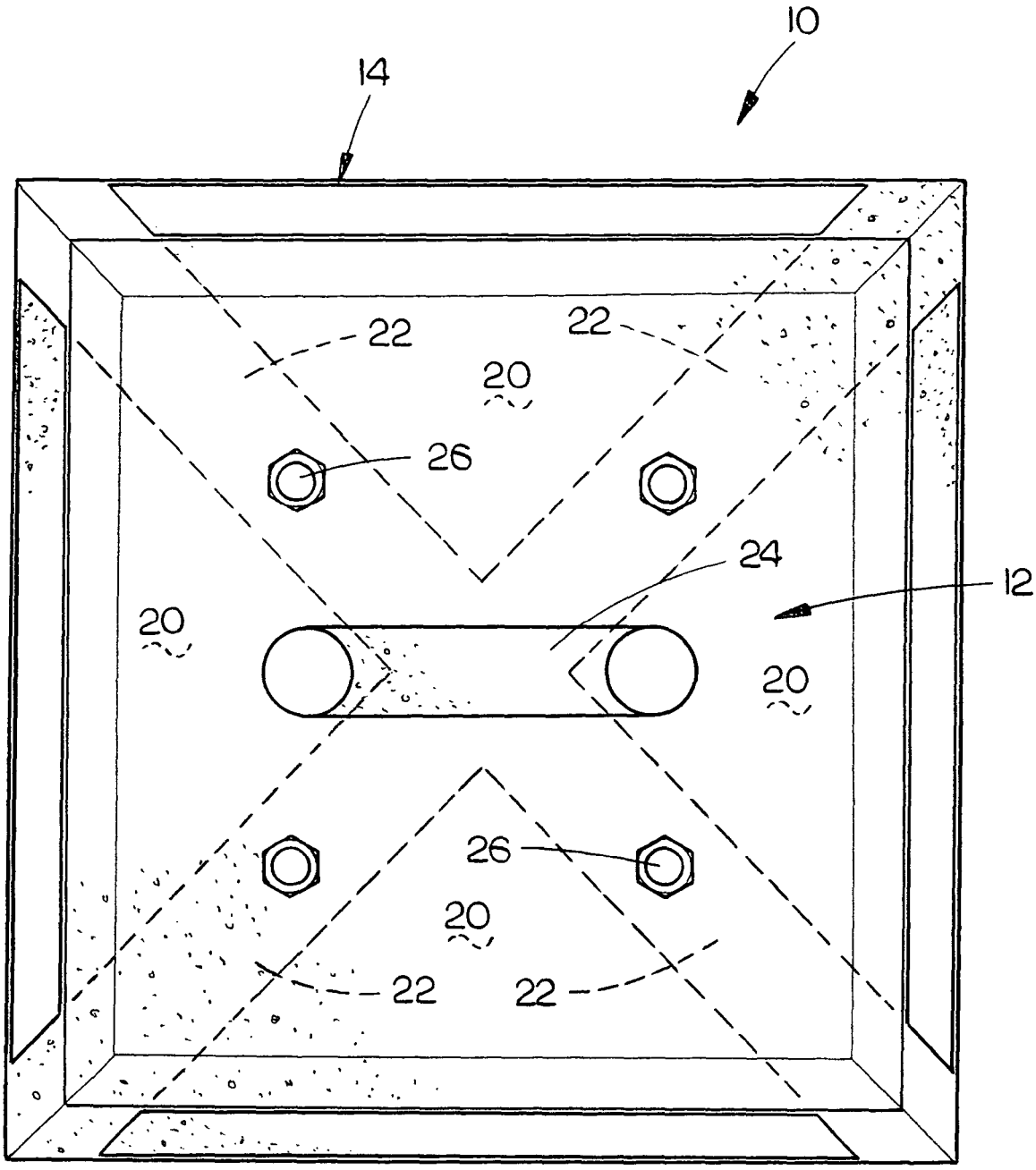
FIG. 4 is a top elevational view of the foundation of this invention.

Base section 14 has a central opening 29 formed therein which is complimentary in shape to the lower end of the central section 12. Central opening 29 of base portion 14 defines an inner wall 30 which has the same angular configuration as the wall 28 of central section 12. The base section 14 is positioned around the lower end of the central section 12 as illustrated in FIGS. 2 and 3. Once so positioned, as illustrated in FIGS. 3 and 5, the engagement of the wall 30 with the wall 28 anchors the central section 12 in place. If additional weight is needed, additional base sections 14 may be stacked on the lowermost base section 14 as illustrated by broken lines in FIG. 5. Base portion 14 is provided with a lifting bar 32 on opposite sides thereof.

Inasmuch as all railroads use standard signal fixtures, by way of this invention, applicant proposes a standard design foundation which may be easily modified for applications which are out of the norm. The standard bolt spacing on 90% or more of the signal equipment used by the railroads is a square four-bolt pattern 11 and 11/16 inches apart. The one-inch bolts usually project about six inches above the foundation to accommodate three sets of nuts and washers, with the middle set of nuts serving as the leveling device before securing the fixture with the top set of nuts. The 11 and 11/16 inch spacing pattern is the same, even though the fixtures are made several different companies.

Certain other applications may require a 19"×19" configuration, such as certain automatic highway crossing gates and cantilever signal foundations. The foundation of applicant's foundation with a 24"×24" top surface will accommodate the 19"×19" bolt spacing if required. An interchangeable top section of the form with either bolt configuration would be the only requirement to produce both foundations.

Applicant's foundation is best described as a "sectional" foundation which does not require extensive full-length through-bolts to securely hold the sections together. In application, the central section 12 is set in the ground and is leveled in the hole. Next, the base section 14, whose central opening has precisely the same angle and dimensions as the lower outside dimensions of the central section 12 is dropped in place over the previously positioned central section 12. As the base section 14 is lowered to ground level, it securely locks the central section 12 by the wedge-action obtained by the design of having a tapered void in the base with the small opening at the top and at the bottom.

Even though the base section 14 is not bolted to the central section 12, the completed unit cannot tip or become up-rooted because the base section will not permit the central section 12 to move, and the compacted earth on top of the base section 14 will not permit the base section 14 to move.

The versatility of applicant's design is great. Should a heavier base section be required for particularly challenging applications, a second or third base section may be stacked on top of the lowermost base section 14 for more weight and stability as previously described. Only a single size base section is required although only the lowermost base section 14 would fit snuggly to the central section 12. It is conceivable that the central section 12 could be used independently for less severe applications.

It can therefore be seen that the invention accomplishes at least all of its stated objections.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

The invention claimed is:

1. A concrete foundation adapted to be embedded in the ground for supporting a pole thereon, comprising:

a vertically disposed central section having upper and lower ends;

said central section being tapered inwardly from its said lower end to its said upper end so that said lower end of said central section has a greater width than the width of said upper end of said central section;

the taper of said central section creating an angularly disposed outer periphery at said lower end of said central section;

a generally horizontally disposed base section having a central opening formed therein which is complimentary to said lower end of said central section so that said base portion may be positioned around said lower end of said central section;

said central opening being defined by an angular wall which corresponds to said angularly disposed outer periphery at said lower end of said central section so that the angular wall of said base section engages said angularly disposed outer periphery at said lower end of said central section to resist movement of said central section with respect to said base section;

said central section having a plurality of anchor bolts embedded therein which have threaded upper ends protruding from said upper end of said central section.

2. The foundation of claim 1 wherein said anchor bolts have lower ends which are spaced above said lower end of said central section.

3. The foundation of claim 1 wherein at least a second base section is positioned on said first base section.

4. The foundation of claim 3 wherein the second base section is identical to said first base section.

5. The foundation of claim 1 wherein said central section has a plurality of spaced-apart cavities formed therein which are spaced from said upper and lower ends of said central section.

6. The foundation of claim 1 wherein said central section has a quadrilateral cross-section.

7. The foundation of claim 6 wherein said base section has a quadrilateral periphery and wherein said central opening therein has a quadrilateral configuration.

* * * * *